US007302811B2

(12) United States Patent
Nungesser et al.

(10) Patent No.: US 7,302,811 B2
(45) Date of Patent: Dec. 4, 2007

(54) FLUID EXPANSION-DISTRIBUTION ASSEMBLY

(75) Inventors: Roy J. Nungesser, Oviedo, FL (US); Juliette Myles, Oviedo, FL (US)

(73) Assignee: Parker Hannifin Corporation, Cleveland, OH (US)

( * ) Notice: Subject to any disclaimer, the term of this patent is extended or adjusted under 35 U.S.C. 154(b) by 270 days.

(21) Appl. No.: 11/283,649

(22) Filed: Nov. 21, 2005

(65) Prior Publication Data

US 2006/0107689 A1 May 25, 2006

Related U.S. Application Data

(60) Provisional application No. 60/630,496, filed on Nov. 23, 2004.

(51) Int. Cl.
*F25B 41/06* (2006.01)

(52) U.S. Cl. ..... 62/527; 62/528

(58) Field of Classification Search ..... 62/324.6, 62/504, 511, 525, 527; 165/174; 137/513; 236/92 B See application file for complete search history.

(56) References Cited

U.S. PATENT DOCUMENTS

| | | | | |
|---|---|---|---|---|
| 2,195,925 A | | 4/1940 | Hoesel | 210/164 |
| 3,110,162 A | | 11/1963 | Gerteis | 62/196 |
| 5,251,459 A | | 10/1993 | Grass et al. | 62/324.1 |
| 5,341,656 A | * | 8/1994 | Rust et al. | 62/324.6 |
| 5,345,780 A | * | 9/1994 | Aaron et al. | 62/324.6 |
| 5,524,819 A | | 6/1996 | Heffner et al. | 236/92 |
| 5,600,962 A | * | 2/1997 | Aizawa et al. | 62/204 |
| 5,689,972 A | * | 11/1997 | Schuster et al. | 62/511 |
| 5,743,111 A | * | 4/1998 | Sasaki et al. | 62/511 |
| 5,832,744 A | * | 11/1998 | Dorste et al. | 62/528 |
| 5,937,658 A | * | 8/1999 | Black et al. | 62/73 |
| 5,937,665 A | * | 8/1999 | Kiessel et al. | 62/260 |
| 5,946,928 A | * | 9/1999 | Wiggs | 62/260 |
| 6,023,940 A | * | 2/2000 | Abbott et al. | 62/504 |
| 6,158,466 A | * | 12/2000 | Riefler | 137/625.43 |
| 6,357,256 B1 | * | 3/2002 | Mallek | 62/507 |
| 6,418,741 B1 | | 7/2002 | Nungesser et al. | 62/225 |
| 6,502,413 B2 | * | 1/2003 | Repice et al. | 62/225 |
| 6,763,673 B2 | | 7/2004 | Oberley et al. | 62/324.6 |

FOREIGN PATENT DOCUMENTS

JP 10-220893 A * 8/1998

* cited by examiner

*Primary Examiner*—Mohammad M. Ali
(74) *Attorney, Agent, or Firm*—Renner, Otto, Boisselle & Sklar

(57) ABSTRACT

An expansion-distribution assembly (30) for the heat-absorbing component in a heatpump system. The assembly (30) comprises an envelope (32) forming an expansion chamber (54) and a distribution chamber (56). A shuttle (80) within the distribution chamber (56) is movable between a first position in response to fluid flowing in the forward direction and a second position in response to fluid flowing in the reverse direction. The shuttle (80) restricts flow when fluid is flowing in the first direction but is less restrictive when fluid is flowing in the second direction.

20 Claims, 3 Drawing Sheets

FLUID EXPANSION-DISTRIBUTION ASSEMBLY

RELATED APPLICATION

This application claims priority under 35 U.S.C. § 119(e) to U.S. Provisional Patent Application No. 60/630,496 filed on Nov. 23, 2004. The entire disclosure of this earlier provisional application is hereby incorporated by reference.

FIELD OF THE INVENTION

This invention relates generally to a fluid expansion-distribution assembly and, more particularly, to an assembly that expands (e.g., throttles) and then distributes refrigerant fluid at the inlet of a heat-absorbing component in a heat-pump system.

BACKGROUND OF THE INVENTION

A heatpump system can be used to control the temperature of a certain medium such as, for example, the air inside of a building. A heatpump system generally comprises an evaporator, a condenser, a compressor and a series of lines (e.g., pipes, tubes, ducts) connecting these components together so that a refrigerant fluid can cycle therethrough. Typically, the evaporator is located adjacent to or within the medium (e.g., it is located inside the building) and the condenser is located remote from the medium (e.g., it is located outside of the building).

A heatpump system can operate in a first (forward) direction, wherein it cools the temperature-controlled environment, and a second (reverse) direction, wherein it heats the temperature-controlled environment. In the forward (i.e., cooling) direction, the evaporator is the heat-absorbing component (i.e., it absorbs heat from, and thus cools, the medium) and the condenser is the heat-rejecting component (i.e., it rejects the absorbed heat to the remote location). In the reverse (i.e., heating) direction, the evaporator is the heat-rejecting component and the condenser is the heat-absorbing component.

In a heatpump cycle, refrigerant fluid enters the heat-absorbing component as a low pressure and low-temperature vapor-liquid. As the vapor-liquid passes through the heat-absorbing component, it is boiled into a low pressure gas state. From the heat-absorbing component, the fluid passes through the compressor, which increases the pressure and temperature of the gas. From the compressor, the high pressure and high temperature gas passes through the heat-rejecting component whereat it is condensed to a liquid.

A heatpump system will often include an expansion valve immediately (or almost immediately) upstream of the heat-absorbing component. When the high pressure and high temperature liquid from heat-rejecting component passes through the expansion valve, the pressure of the fluid is reduced (e.g., the expansion valve throttles the fluid) and fluid is converted to a low pressure and low temperature vapor/liquid state. This low pressure and low temperature vapor/liquid is received by the heat-absorbing component to complete the cycle.

A heatpump cycle will often also include a distributor just downstream of the expansion valve. A distributor commonly includes a mixing compartment whereat fluid is evenly distributed to a plurality of tubes which feed the multiple circuits of the heat-absorbing component. A distributor can also include a flow restriction (e.g., a nozzle) upstream of its mixing compartment which increases the velocity of the fluid just prior to its entry into the mixing compartment to promote a turbulent mixing of liquid and vapor phases. For economic and/or envelope-size reasons, the distributor is often attached directly to the expansion valve to form an expansion-distribution assembly.

As was indicated above, when a heatpump system is operating in a first (i.e., forward and/or cooling) direction, the evaporator is the heat-absorbing component, and when it is operating in a second (i.e., reverse and/or heating) direction, the condenser is the heat-absorbing component. Thus, an expansion-distribution assembly may be positioned at the end of the evaporator which is its inlet when fluid travels in the first direction and/or may be positioned at the end of the condenser which is its inlet when fluid travels in the second direction.

When a heatpump system is operating in a direction corresponding to the expand-then-distribute direction, liquid (at a high pressure and high temperature) will pass through the expansion-distribution assembly and will be converted into a vapor/liquid (at a lower pressure and a lower temperature) for receipt by the heat-absorbing component. When the heatpump system is operating in the opposite direction, fluid passes "backwards" through the expansion-distribution assembly. An expansion-distribution assembly will typically include a gate mechanism (e.g., a check valve) to provide a throttle-bypassing passage when fluid travels backwards through the expansion chamber. Thus, the gate mechanism eliminates any premature and/or inefficient throttling of fluid in the expansion chamber during backward flow. However, the fluid must still travel backwards through the distribution chamber to reach the expansion chamber, and this backward flow of fluid through the distributor's velocity-increasing flow path can sometimes cause a relatively significant and, in any event, undesirable, pressure drop.

SUMMARY OF THE INVENTION

The present invention provides an expansion-distribution assembly wherein the distributor provides a velocity-increasing flow path to its mixing compartment when the fluid flows in a first (forward) direction but does not cause a large pressure drop when the fluid flows in a second (reverse) direction. In this expansion-distribution assembly, a shuttle restricts flow in a velocity-increasing manner when fluid travels in the first direction but is less restrictive when fluid travels in the second direction. Thus, there is no need to balance the desire for a high velocity in the first direction (for fluid mixing and distribution purposes) with the need to minimize pressure drop when fluid travels in the second direction (for cycle efficiency and capacity reasons).

More particularly, the present invention provides an expansion-distribution assembly comprising an envelope forming an expansion chamber and a distribution chamber. Valve components in the expansion chamber provide a pressure-decreasing path when fluid travels in a first direction (i.e., through the expansion chamber to the distribution chamber) and allow bypassing of the pressure-decreasing path when fluid travels in a second direction (i.e., through the distribution chamber to the expansion chamber). A shuttle within the distribution chamber which is movable between a first position in response to fluid flowing in the first direction and a second position in response to fluid flowing in the second direction. The shuttle restricts flow when fluid is flowing in the first direction but is less restrictive when fluid is flowing in the second direction.

The shuttle can comprise a body with a first passageway and one or more second passageways extending therethrough. When the shuttle is in its first position, fluid flows through the first passageway and, when the shuttle is in its second position, fluid flows through the second passageway(s). Preferably, the fluid flows only through the first passageway in the first shuttle position and/or fluid flows through both the first passageway and the second passageway(s) in the second shuttle position. Additionally or alternatively, the expansion-distribution assembly is designed so that there is an at least partial blocking of the second passageway(s) in the first shuttle position, thereby positively preventing fluid from flowing therethrough.

These and other features of the invention are fully described and particularly pointed out in the claims. The following description and drawings set forth in detail a certain illustrative embodiment of the invention which is indicative of but one of the various ways in which the principles of the invention may be employed.

DRAWINGS

DETAILED DESCRIPTION

Figure 1:
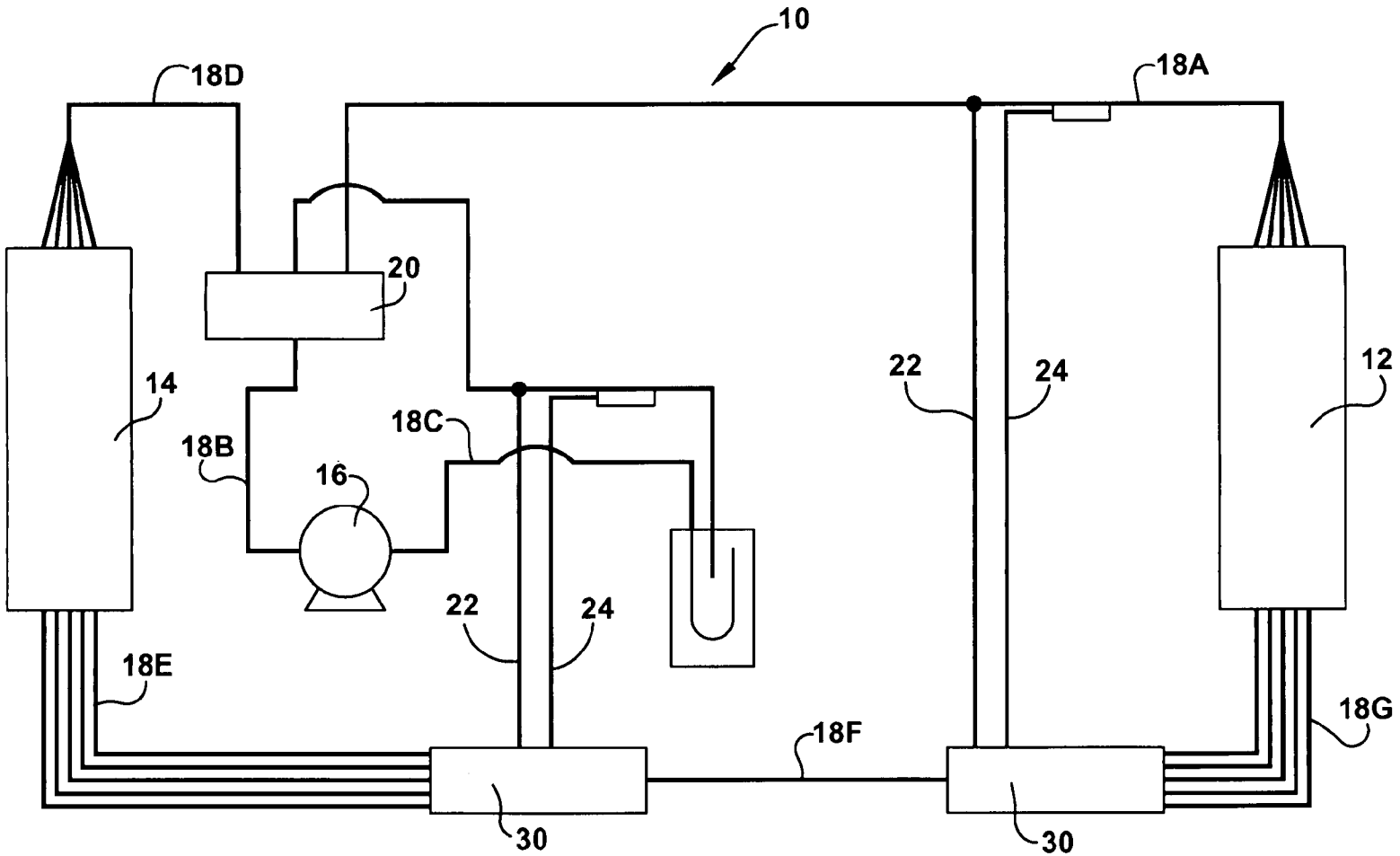
FIG. 1 is a schematic view of a heatpump system according to the present invention.

Referring now to the drawings, and initially to FIG. 1, a heatpump system 10 according to the present invention is schematically shown. The heatpump system 10 can be used to control the temperature of a certain medium (e.g., air inside a building) and generally comprises an evaporator 12, a condenser 14, and a compressor 16. A plurality of lines 18 (e.g., pipes, tubes, ducts) connect these components so that refrigerant fluid can cycle therethrough. The evaporator 12 can be located within the medium (i.e., it can be located inside the building) and the compressor can be located remote from the medium (i.e., it can be located outside of the building).

The heatpump system 10 can operate in a first (forward) direction, whereat it cools the medium, and a second (reverse) direction, whereat it heats the medium. A reversing valve 20, or other flow-direction-determining means, can be used to select the direction of flow through the heatpump system 10. In the first (i.e., forward and/or cooling) direction, the evaporator 12 is the heat-absorbing component (i.e., it absorbs heat from, and thus cools, the medium) and the condenser 14 is the heat-rejecting component (i.e., it rejects the absorbed heat to a location outside of the medium). In the second (i.e., reverse and/or heating) direction, the evaporator 12 is the heat-rejecting component and the condenser 14 is the heat-absorbing component. In the forward mode of operation, fluid flows from the evaporator 12 to the intake compressor 16, from the discharge of the compressor 16 to the condenser 14, and then from the condenser 14 back to the evaporator 12 to complete the cycle. In the reverse mode of operation, fluid flows from the condenser 14 to the intake of the compressor 16, from the discharge of the compressor 16 to the evaporator 12, and then from the evaporator 12 back to the condenser 14 to complete the cycle.

The heatpump system 10 can additionally comprise temperature and pressure sensing lines 22 and 24. One set of sensing lines 22/24 is connected to the cycle lines 18 to sense the temperature and pressure of the gas exiting the evaporator 12 when fluid travels in the first direction. The other set of sensing lines 22/24 is connected to the cycle lines 18 to sense the temperature and pressure of the gas exiting the condenser 14 when fluid travels in the second direction.

The heatpump system 10 includes at least one expansion-distribution assembly 30 according to the present invention and/or the system 10 can include two expansion-distribution assemblies 30 as shown in the illustrated embodiment. An expansion-distribution assembly 30 can be located adjacent to the end of the evaporator 12 that acts at its inlet when fluid travels in the first (i.e., forward and/or cooling) direction. Additionally or alternatively, an expansion-distribution assembly 30 can be located adjacent to the end of the condenser 14 that acts as its inlet when fluid travels in the second (i.e., reverse and/or heating) direction.

Figure 2:
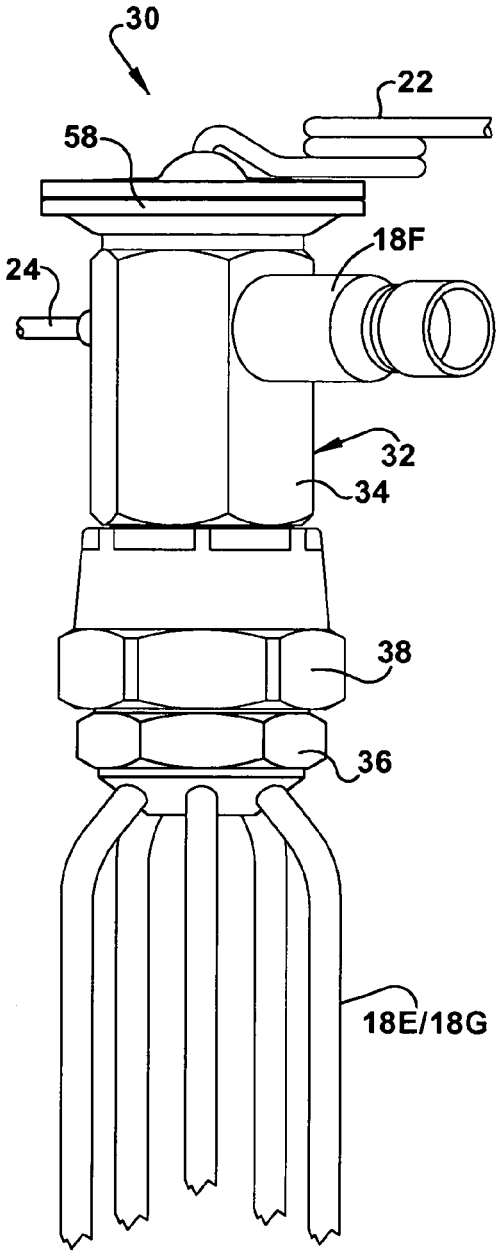
FIG. 2 is a side view of an expansion-distribution assembly according to the present invention.
Figure 3:
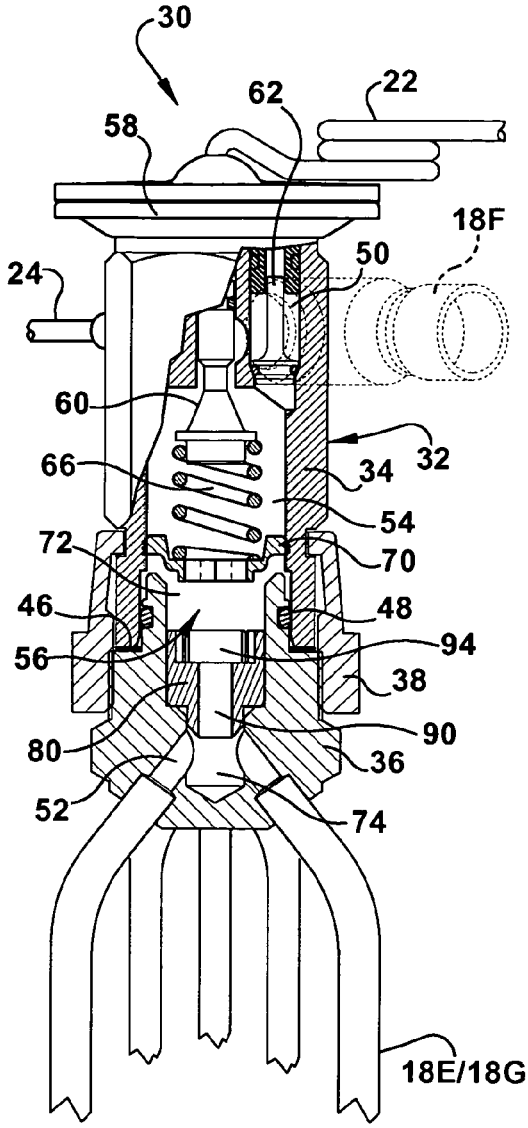
FIGS. 3 and 4 are partially in section views of the expansion-distribution assembly, with FIG. 3 showing the assembly when fluid travels in a first direction and FIG. 4 showing the assembly when fluid travels in a second direction.
Figure 4:
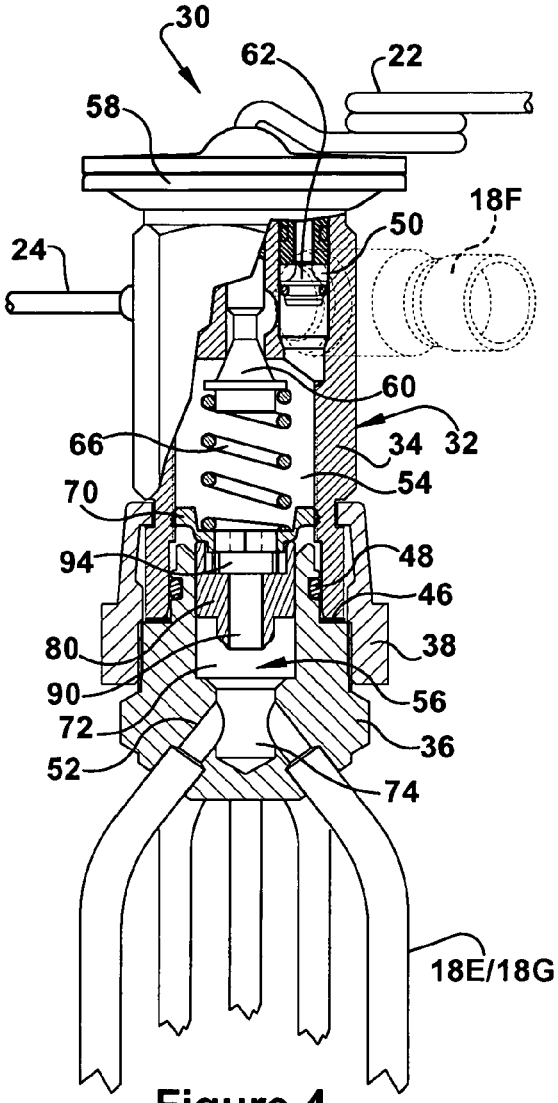
Figure 5:
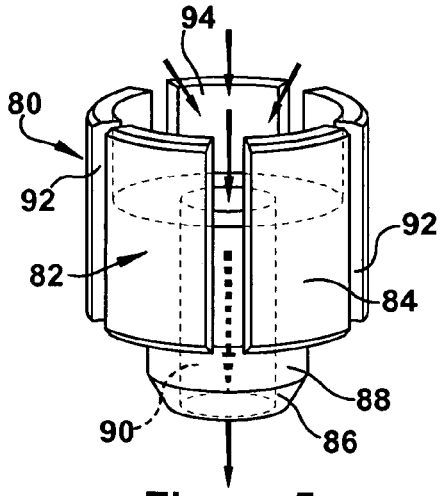
FIGS. 5 and 6 are perspective views of a shuttle of the expansion-distribution assembly, with FIG. 5 schematically showing the flow path through the shuttle when fluid travels in the first direction and FIG. 6 schematically showing the flow paths through the shuttle when fluid travels in the second direction.
Figure 6:
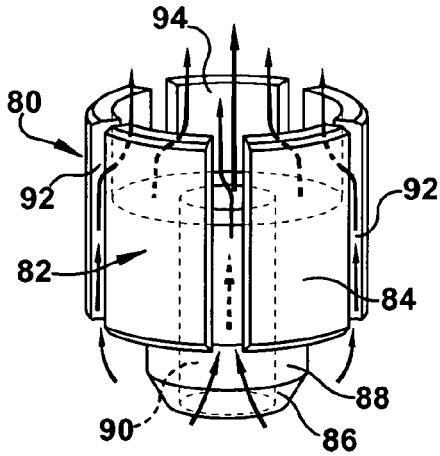

Referring now to FIGS. 2 and 3, the expansion-distribution assembly 30 according to the present invention is shown in more detail. The assembly 30 comprises an envelope 32 which, in the illustrated embodiment, is made from parts 34 and 36 which are connected together by a swivel nut 38. The parts 34 and 36, and/or the nut 38, can be made of any suitable material (e.g., metals and/or plastics) which provide the necessary structural requirements, are tolerant of the expected refrigerant fluid, and/or are resistant to the intended environment of the assembly 30.

The axial end of the part 34 rests on a shelf formed by an axial edge of the part 36 and a seal 46 is positioned therebetween. The seal 46 can be an elastomer coated metal washer, with the metal (e.g., carbon steel, stainless steel, copper, brass, aluminum, etc.) and the elastomer (e.g., nitrile and neoprene) being compatible with, and/or tolerant to, the intended refrigerant fluid and expected valve oils. If the seal 46 has an elastomer coating, it can have a relatively small cross-section area to minimize refrigerant permeation therethrough. Alternatively, the seal 46 can have a metal/metal construction, can be made of semi-rigid material (e.g., Teflon®) or can be made of a hybrid of metal and other soft or semi-rigid seal material.

A radially inner surface of the envelope part 34 is flush with a radially outer surface of the envelope part 36, and a seal 48 is positioned therebetween. The seal 48 can be an O-ring situated within a groove on the radially outer surface of the envelope part 36 (as shown) and/or within a groove on the radially inner surface of the envelope part 34. The seal 48 can be made of an elastomer material or any other material providing the required sealing properties. The cross-section shape of the seal 48 can be circular (as shown) or another appropriate shape (e.g., oval, polygonal, irregular etc.).

The two-seal design of the expansion-distribution assembly 30 assures a leak-proof and pressure-tight seal between the envelope parts 34/36. The two seals 46 and 48 produce a robust inter-part joint thereby preventing (or at least minimizing) refrigerant leaks during manufacturing and during field use. The respective diameters of the seals 46 and 48 can be chosen such that the axial seal 46 is retained on the part 36 once the radial seal 48 is installed (e.g., the inside diameter of the seal 46 can be less than the outside diameter of the seal 48).

The envelope 32 has a first opening 50, defined by the part 34 in the illustrated embodiment, and a second opening 52, defined by the part 36 in the illustrated embodiment. The envelope 32 also has an expansion chamber 54, formed primarily by part 34 and a distribution chamber 46, formed primarily by the part 36. The expansion chamber 54 communicates with the first opening 50, and the distribution chamber 52 communicates with the expansion chamber 54 and the second openings 52. The envelope 32 can additionally include a diaphragm chamber 58 which interacts with a component (namely a throttling-piston 60, introduced below) within the expansion chamber 34.

The first opening 50 will typically comprise a single opening which is connected to, for example, a single line of the heatpump system 10 (e.g., line 18F in the illustrated embodiment). The second opening 52 will typically comprises a plurality (e.g., five) of openings which connect with parallel circuit-feeding lines to the heat-absorbing component 12/14 (e.g., lines 18G or lines 18E in the illustrated embodiment). In the expansion-distribution assembly 30 positioned adjacent to the evaporator 12, the first opening 50 acts as an inlet and the second openings 52 act as outlets when the fluid is flowing in the first direction. In the expansion-distribution assembly 30 positioned adjacent the condenser 14, the openings 50 and 52 act as an inlet and outlets, respectively, when fluid travels in the second direction. The inlet/outlet roles of the openings 50 and 52 are switched when fluid travels in the opposite direction for each of the assemblies 30.

For ease in explanation, the expansion-distribution assembly 30 is hereafter described in relation to the assembly positioned adjacent the evaporator 12. In other words, the description will correspond to the first opening 50 being the inlet and the second opening(s) 52 being the outlet(s) when fluid travels in the first direction, and vice-a-versa when fluid travels in the second direction. The description of the expansion-distribution assembly 30 positioned adjacent the condenser 14 would be essentially the same, except that the first direction would be considered the second direction and the second direction would be considered the first direction.

The expansion-distribution assembly 30 can comprise valve components 60 and 62 positioned within the expansion chamber 54. The valve component 60 can be a pressure-lowering device, such as the illustrated throttling piston which is adjustably controlled by a diaphragm (located inside the diaphragm chamber 58 and not visible in the illustrated views) influenced by the temperature and pressure sensing lines 22 and 24. The throttling piston 60 can be biased to a closed condition by a spring 66 which, in the illustrated embodiment, has a base mounted on a ledge 70 within the expansion chamber 54. As is explained in more detail below, the ledge 70 also acts as a stop for a distribution component (namely a shuttle 80, introduced below) of the assembly 30.

The component 62 within the expansion chamber 54 can comprise a check device or other analogous gate-like mechanism. When fluid travels in the second direction, and thus backwards through the assembly 30, this check device 62 opens a flow path bypassing the throttling path of the pressure-decreasing piston 60. This bypass prevents fluid from experiencing an undesirable pressure drop as it travels backwards through the expansion chamber 54.

The distribution chamber 56 can comprise a cylindrical slide compartment 72 adjacent the expansion chamber 54 and a mixing compartment 74 adjacent the second outlet(s) 52. The slide compartment 72 has an outwardly tapered edge connecting it to the expansion chamber 52 and an inwardly tapered edge connecting it to the mixing compartment 74. The mixing compartment 74 has a geometry and size promoting even distribution of fluid into the outlets 52 when fluid travels in the first direction.

The expansion-distribution assembly 30 further comprises a shuttle 80 which can be made of any suitable material such as brass (which may be preferred due to its ease of fabrication) and/or refrigerant-compatible plastics. The shuttle 80 is positioned within the distribution compartment 74 and is movable between a first position in response to fluid flowing in the first direction and a second position in response to fluid flowing in the second direction. In the illustrated embodiment, the shuttle 80 shifts away from the expansion chamber 54 when moving to its first position and towards the expansion chamber 54 when moving to its second position.

The illustrated shuttle 80 comprises a body 82 having a base portion 84, a nose portion 86, and a connecting portion 88 therebetween. The shuttle's base portion 84 has a cylindrical shape with a diameter allowing it to have a telescoping and/or close-slide fit within the compartment 72. The nose portion 86 has a truncated-cone shape with its widest diameter being positioned nearest to the connection portion and being less than the diameter of the base position 84. The connecting portion 88 has cylindrical shape equal to the widest diameter of the nose portion 86, whereby it forms a connecting step portion between the base portion 84 and the nose portion 86.

A first passage 90 extends centrally through the shuttle portions 84, 86 and 88, and second passages 92 extend axially along the radially outer surface of the base portion 84. A cup-shaped cavity 94 is situated in the exposed axial face of the base portion 84. The first passage 90 opens axially into the cavity 94 and the second passages 92 open radially into to the cavity. The first passage 90 defines a given flow area (a circular flow area in the illustrated embodiment) and the passages 92 also each define a given flow area (semi-circular flow areas in the illustrated embodiment). Needless to say, the flow area provided by just the central passage 90 is less than the combined flow area provided by both the passage 80 and the passages 92.

The shuttle 80 is moved to its first position by fluid traveling in the first direction and pushing it towards the mixing compartment 74. When in this position, its nose portion 86 is protrudes partially into the mixing compartment 74 and the connecting step portion 88 contacts the tapered edge between the compartments 72 and 74. Thus, the connecting step 88 acts as a stop which limits the movement of the shuttle 80 in the first direction. In this first shuttle position, the radial passages 92 are blocked by the contact between the connecting step 88 and the tapered edge between the distribution compartments 72/74. Fluid flows only through the central passage 90 as it passes from the expansion chamber 54 to the mixing compartment 74.

The shuttle 80 is moved to its second position by fluid traveling in the second direction and pushing it towards the expansion chamber 54. When in this position, the axial edge of the base portion 84 (surrounding the cavity 94) contacts the ledge 70 whereby it acts as a stop which limits movement of the shuttle 80 in the second direction. The shuttle nose portion 86 is situated within the slide compartment 72 with open space therearound whereby the passages 92 are not blocked. Fluid passes through the central passage 90 to the cavity 94, and also through the radial passages 92 and into the cavity 94, on route to the expansion chamber 54.

Accordingly, the shuttle 80 restricts flow when fluid is flowing in the first direction but is less restrictive when fluid is flowing in the second direction. In other words, the shuttle 80 defines a flow area (i.e., the flow area defined by the passage 90) when in its first position and a greater flow area (i.e., the flow area provided by the passage 90 and the passages 92) when in its second position. Significantly, this restriction of flow and/or definition of flow area is accomplished by the positive blocking of the passages 92 when the shuttle 80 is in the first position. This restriction and/or definition is not determined by, and/or dependent on, a special flow pattern created by the throttling piston when fluid flows through the expansion chamber 54 in the first direction.

The blocking of the passages 92 in the first shuttle position can be accomplished, as shown, by contact between shuttle/chamber surfaces. A tight seal between these contacting surfaces is not necessarily required, the blocking must merely discourage the majority of fluid from passing through the passages 92. That being said, the addition of seals and/or the modification of shuttle/chamber surface geometry to tighten or enhance the blocking of the passages 92 is certainly possible with, and contemplated by, the present invention. Also, although the illustrated shuttle 80 includes only one central passage 90, this passage could comprise a plurality of passageways extending centrally (or otherwise) through the shuttle body 82. Likewise, the passages 92 could comprise less (e.g., one) or more passageways and/or they could be arranged otherwise relative to the body 82 and/or the central passage 90. A design where fluid passes through the passages 92, but not the passage 90, when the shuttle is in the second position is also possible.

The expansion-distribution assembly 30 of the present invention allows an optimum nozzle design to dictate the dimension (e.g. diameter) of the velocity-increasing passage 90. The smallness of this dimension need not be compromised to prevent an unduly large pressure drop when fluid flows backwards through the assembly 30, as this pressure drop can be addressed by the number and/or size of the passages 92. Additionally or alternatively, the functioning of the throttling piston 60 and/or the dimensioning of the passage 90 need not be directly concerned with the creation of special flow patterns as they are not needed to assure that fluid is guided in a velocity-increasing path when fluid flows in the first direction.

One may now appreciate the present invention provides an expansion-distribution assembly 30 wherein the distributor provides a velocity-increasing flow path to its mixing compartment 74 when the fluid flows in a first direction but does not cause a large pressure drop when the fluid flows in a second (reverse) direction. Although the invention has been shown and described with respect to a certain preferred embodiment, it is obvious that equivalent and obvious alterations and modifications will occur to others skilled in the art upon the reading and understanding of this specification. The present invention includes all such alterations and modifications and is limited only by the scope of the following claims.

The invention claimed is:

1. An expansion-distribution assembly, comprising:

an envelope defining an expansion chamber and an distribution chamber which communicate with each other;

valve components in the expansion chamber which provide a pressure-decreasing path when fluid travels in a first direction through the expansion chamber to the distribution chamber and which allow bypassing of the pressure-decreasing path when fluid travels in a second direction through the distribution chamber to the expansion chamber;

a shuttle within the distribution chamber which is movable between a first position in response to fluid flowing in the first direction and a second position in response to fluid flowing in the second direction;

wherein the shuttle restricts flow when fluid is flowing in the first direction but is less restrictive when fluid is flowing in the second direction.

2. An expansion-distribution assembly as set forth in 1, wherein the valve components comprise:

a throttling member which provides the pressure-lowering path when fluid travels in the first direction; and/or a check member which allows bypassing of the pressure-lowering path when fluid travels in the second direction.

3. An expansion-distribution assembly as set forth in claim 1, wherein the distribution chamber includes a mixing compartment and wherein the shuttle is positioned between the mixing compartment and the expansion chamber.

4. An expansion-distribution assembly as set forth in claim 1, wherein the shuttle defines a flow area when in its first position and a larger flow area when in its second position.

5. An expansion-distribution assembly as set forth in claim 1, wherein the shuttle moves towards or away from the expansion chamber as it moves between its first position and its second position.

6. An expansion-distribution assembly as set forth in claim 1, wherein the shuttle comprises:

a body;

a first passage extending through the body through which fluid flows when the shuttle is in its first position; and a second passage extending through the body through which fluid flows when the shuttle is in its second position.

7. An expansion-distribution assembly as set forth in claim 6, wherein the second passage is at least substantially blocked when the shuttle is in its first position and fluid flows through this passage when the shuttle is in its second position.

8. An expansion-distribution assembly as set forth in claim 7, wherein fluid flows through both the first passage and the second passage when the shuttle is in its second position.

9. An expansion-distribution assembly as set forth in claim 6, wherein the shuttle comprises a plurality of second passages which are at least substantially blocked when the shuttle is in its first position and through which fluid flows when the shuttle is in its second position.

10. An expansion-distribution assembly as set forth in claim 9, wherein the first passage extends substantially centrally through the body.

11. An expansion-distribution assembly as set forth in claim 10, wherein the second passages extend axially along radially outer portions of the body.

12. An expansion-distribution assembly as set forth in claim 11, wherein the shuttle comprises a base portion and a nose portion extending therefrom;

wherein the first passage extends through the base portion and the nose portion; wherein the second passages extend through the base portion and terminate at a step portion between the base portion and the nose portion.

13. An expansion-distribution assembly as set forth in claim 12, wherein contacting surfaces of the envelope and the shuttle block the second passages when the shuttle is in its first position.

14. An expansion-distribution assembly as set forth in claim 13, wherein distribution-chamber-defining surfaces of the envelope and the stepped portion of the shuttle block the second passages when the shuttle is in its first position.

15. An expansion-distribution assembly as set forth in claim 1, wherein the envelope comprises a first part, a second part, a first seal between adjacent axial surfaces of the first part and the second part, and a second seal between adjacent radial surfaces of the first part and the second part.

16. An expansion-distribution assembly as set forth in claim 15, wherein the second seal is positioned between an inner radial surface of the first part and an outer radial surface of the second part.

17. An expansion-distribution assembly as set forth in claim 16, wherein the second seal is situated within a groove in the first part and/or the second part.

18. A heatpump system comprising:

a first component which acts as a heat-absorbing component when fluid is flowing in a first direction and as a heat-rejecting component when fluid is flowing in a second direction;

a second component which as a heat-rejecting component when fluid is flowing in a first direction and as a heat-absorbing component when fluid is flowing in a second direction; and at least one expansion-distribution assembly as set forth in claim 1, the expansion-distribution assembly(ies) being positioned:

immediately, or almost immediately, upstream of the inlet of the first component when fluid travels in the first direction; and/or immediately, or almost immediately, upstream of the inlet of the second component when fluid travels in the second direction.

19. An expansion-distribution assembly, comprising:

an envelope defining an expansion chamber and an distribution chamber which communicate with each other;

valve components in the expansion chamber which provide a pressure-decreasing path when fluid travels in a first direction through the expansion chamber to the distribution chamber and which allow bypassing of the pressure-decreasing path when fluid travels in a second direction through the distribution chamber to the expansion chamber; and a shuttle within the distribution chamber which is movable between a first position in response to fluid flowing in the first direction and a second position in response to fluid flowing in the second direction;

wherein the shuttle has a body defining a first passage through which fluid flows when the shuttle is in its first position and defining at least one second passage through fluid flows when the shuttle is in its second position; and wherein the second passage(s) is(are) blocked when the shuttle is in its first position.

20. An expansion-distribution assembly as set forth in claim 19, wherein fluid flows through both the first passage and the second passage(s) when the shuttle is in its second position.

* * * * *